US006454615B1

(12) United States Patent
Yu

(10) Patent No.: US 6,454,615 B1
(45) Date of Patent: Sep. 24, 2002

(54) HIGH-SPEED ELECTRICAL CONNECTOR

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/013,417

(22) Filed: Dec. 7, 2001

(51) Int. Cl.[7] ..... H01R 13/41
(52) U.S. Cl. ..... 439/752.5; 439/943; 439/733.1
(58) Field of Search ..... 439/752.5, 733.1, 439/660, 751, 943

(56) References Cited

U.S. PATENT DOCUMENTS 3,980,385 A * 9/1976 Hirokawa et al. ..... 439/752.5
5,425,661 A * 6/1995 Self, Jr. et al. ..... 439/752.5
5,743,769 A * 4/1998 Koguchi ..... 439/943
6,165,027 A * 12/2000 Huang et al. ..... 439/752.5

* cited by examiner

*Primary Examiner*—Hien Vu
(74) *Attorney, Agent, or Firm*—Wei Te Chung

(57) ABSTRACT

An electrical connector (100) for mounting on a PCB (3) by a tool (5) to electrically connecting different electrical components includes an insulative housing (1) with a plurality of passageways (13) defined therethrough for receiving a corresponding plurality of electrical contacts (2) therein. A plurality of retaining slots (14), each of which is located beside corresponding passageway (13), are defined through a top surface (12) of the housing (1). Each electrical contact (2) has a retaining portion (24) extending upwardly. The retaining portion (24) abuts upwardly against the tool (5) for maintaining the contacts (2) in position when the connector (100) is mounted to the PCB (3).

2 Claims, 6 Drawing Sheets

HIGH-SPEED ELECTRICAL CONNECTOR

BACKGROUND OF THE INVENTION

1. Field of the Invention

The present invention relates to the art of electrical connectors, and more particularly to a high-speed electrical connector having retention mechanism which can prevent contacts retained in the connector from deformation during inserting in a direction perpendicular to a printed circuit board (PCB) when the connector is mounted to the PCB.

2. Description of the Related Art

A conventional high-speed electrical connector 500 commonly has a plurality of electrical contacts 52 as shown in FIGS. 6 and 7, each of which has a press-fit retaining portion 524. When the connector 500 is mounted to a printed circuit board (PCB) 53, the retaining portions 524 of the contacts 52 are inserted into through holes 531 in the PCB 53. Each through hole 531 has a diameter less than a dimension of the retaining portion 524. The connector 500 can be mounted on the PCB 53 by pressing the retaining portions 524 of the contacts 52 into the through holes 531 without additional soldering process.

When the connector 500 is mounted to the PCB 53, the retaining portions 524 of the contacts 52 confront sidewalls of the PCB 53 around the through holes. The contacts 52 are retained in passageways 513 of the housing 51 by barbs 523 protruding from opposite sides of each contact 52. However, the barbs 523 are insufficient to securely retain the contacts 52 in the passageways 513 if the insertion force during the mating process is too high. The contacts 52 will slide upwardly along the passageways 513 as the housing 51 is pressed downwardly, which leads to the contacting portion 521 of the contacts 52 resisting an inner face 518 of a top wall of the housing 51. Under such condition, the contacting portions 521 will bias from their proper position, thereby failing to electrically connect with corresponding contacts of a mating connector (not shown). In addition, the insertion force acted on a tail portion 525 of the contact 52 may subject the tail portion 525 to a force in a direction perpendicular to the insertion direction which alters the pitch of the contacts thereby adversely affecting insertion of the contacts 52 into the holes 531 defined in the PCB 53.

Therefore, an improved connector and compliant contacts are required having an improved retention mechanism for retaining the contacts within a housing of a connector which will eliminate undue deformation of the contacts.

SUMMARY OF THE INVENTION

An object of the present invention is to provide an improved connector with contacts having retaining mechanisms for positioning the contacts in true positions when the connector is mounted to a PCB.

In order to achieve the object set forth, an electrical connector in accordance with the present invention includes an insulative housing defining a plurality of passageways therethrough and a plurality of contacts received in the passageways. A plurality of retaining slots are aligned with the passageways and are defined between top and bottom surfaces of the housing. Each contact has a base portion and a pair of contacting portions received in the passageway of the housing and a press-fit tail portion extending downwardly from the bottom surface of the housing. A retaining portion extends upwardly from the base portion and is inserted into the retaining slot of the housing. The connector can be mounted to a PCB by a tool pressing on the top surface of the housing of the connector, when the tail portions of the contacts are inserted into the through holes of the PCB, the retaining portions of the contacts abut upwardly against the tool. Thus, the contacts are prevented from sliding upwardly along the passageways.

DESCRIPTION OF THE PREFERRED EMBODIMENT

Reference will now be made in detail to the preferred embodiment of the present invention.

Figure 1:
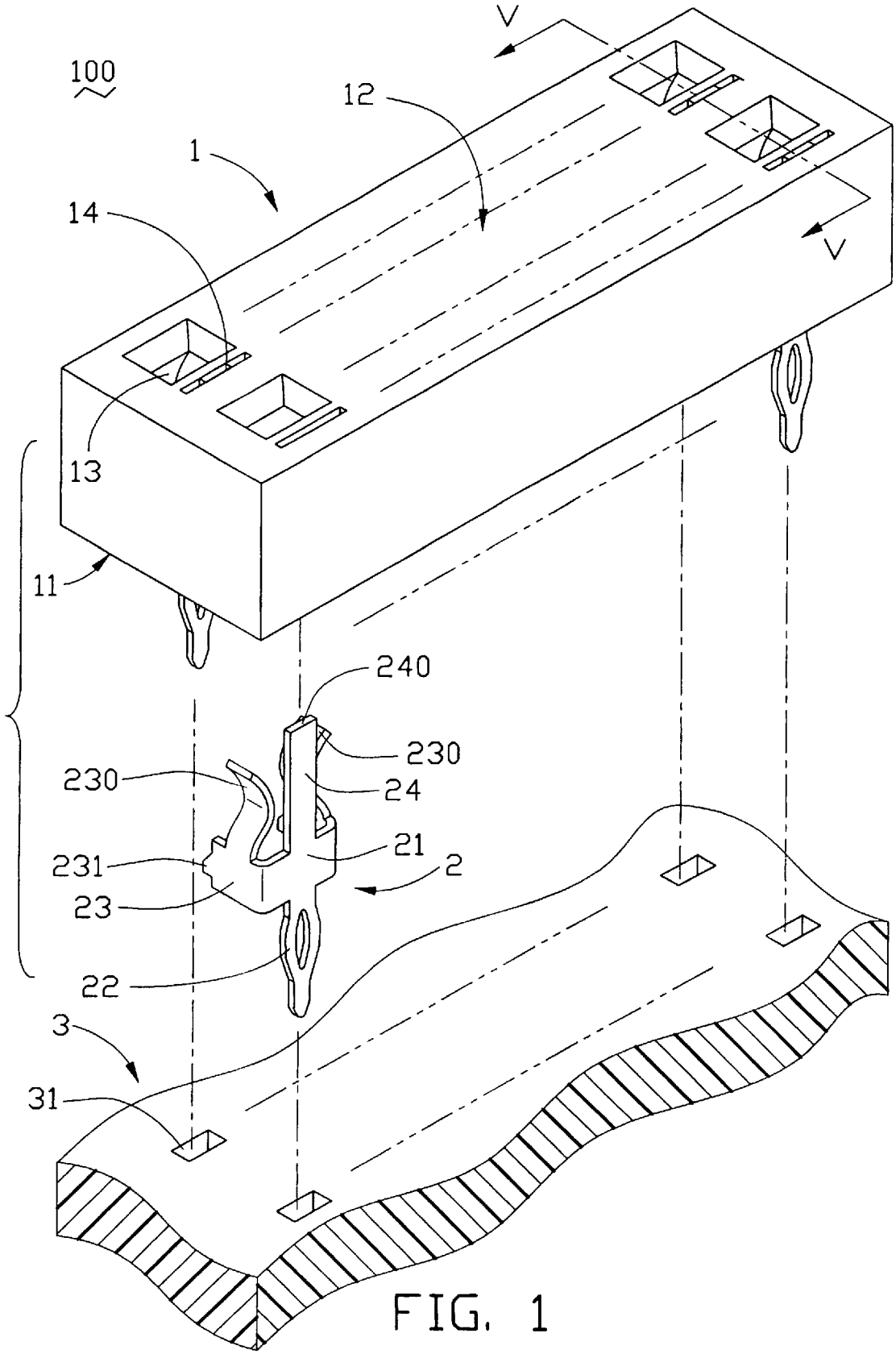
FIG. 1 is an exploded view of an electrical connector in accordance with the present invention together with a PCB.

Referring to FIG. 1, an electrical connector 100 in accordance with a preferred embodiment of the present invention includes an insulative housing 1 and a plurality of electrical contacts 2 received in the housing 1.

Figure 2:
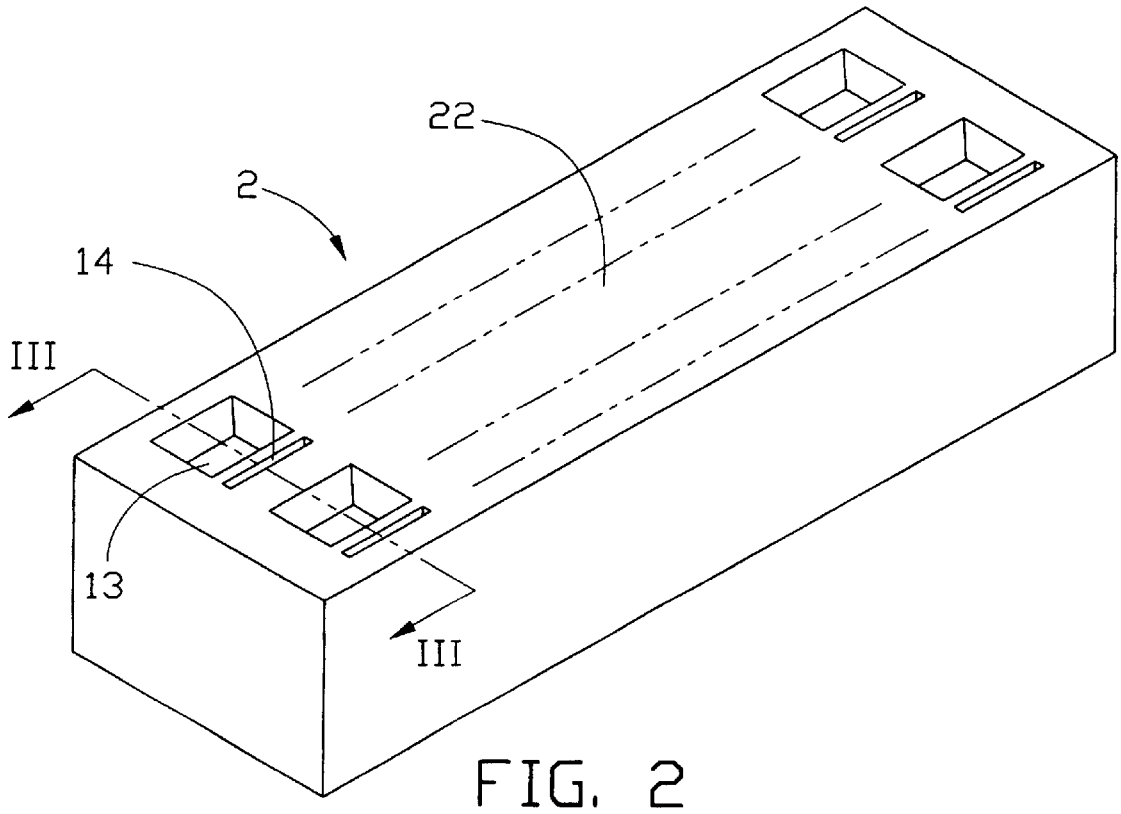
FIG. 2 is a perspective view of an insulative housing of the electrical connector of FIG. 1.
Figure 3:
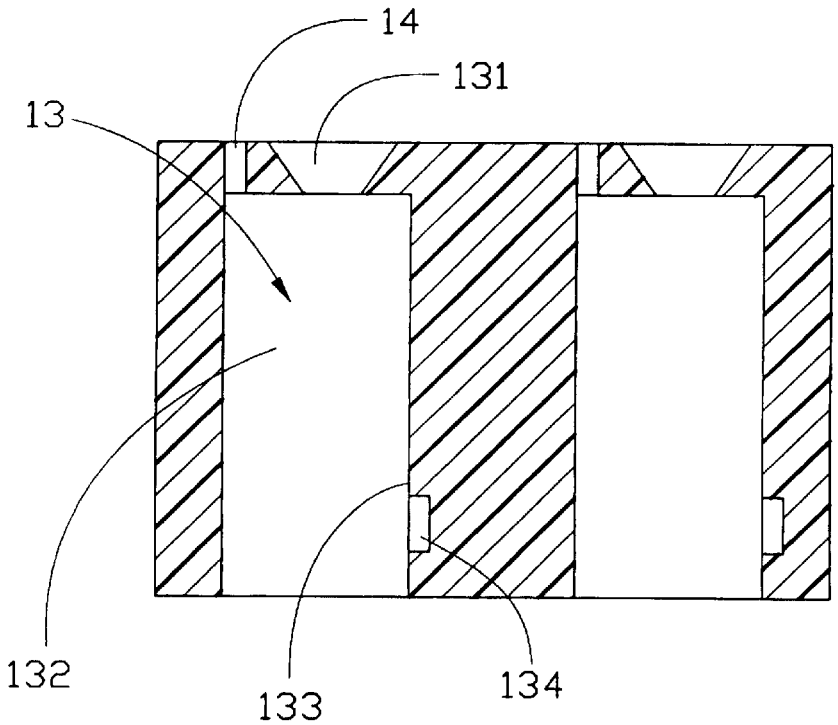
FIG. 3 is a cross-sectional view, taken along line III—III of FIG. 2.

Referring particularly to FIGS. 2 and 3, the housing 1 of the connector 100 has a mounting bottom surface 11 for mounting onto the PCB 3, a mating top surface 12 for mating with a mating connector (not shown), and rows of passageways 13 extending from the top surface 12 to the bottom face 11 for receiving a corresponding plurality of contacts 2 therein. Each passageway 13 has a diverged opening 131 in the top surface 12 of the housing 1 and a receiving room 132 adjacent to the opening 131 and extending downwardly through the bottom surface 11. One inner wall 133 of the receiving room 132 has a pair of recesses 134 concaved therein. A plurality of retaining slots 14, each of which is settled beside corresponding passageway 13, are defined throughout the top surface 12 of the housing 1. The retaining slots 14 are arranged in lines parallel to the rows of passageways 13. Each retaining slot is communicated with corresponding passageway 13.

Figure 4:
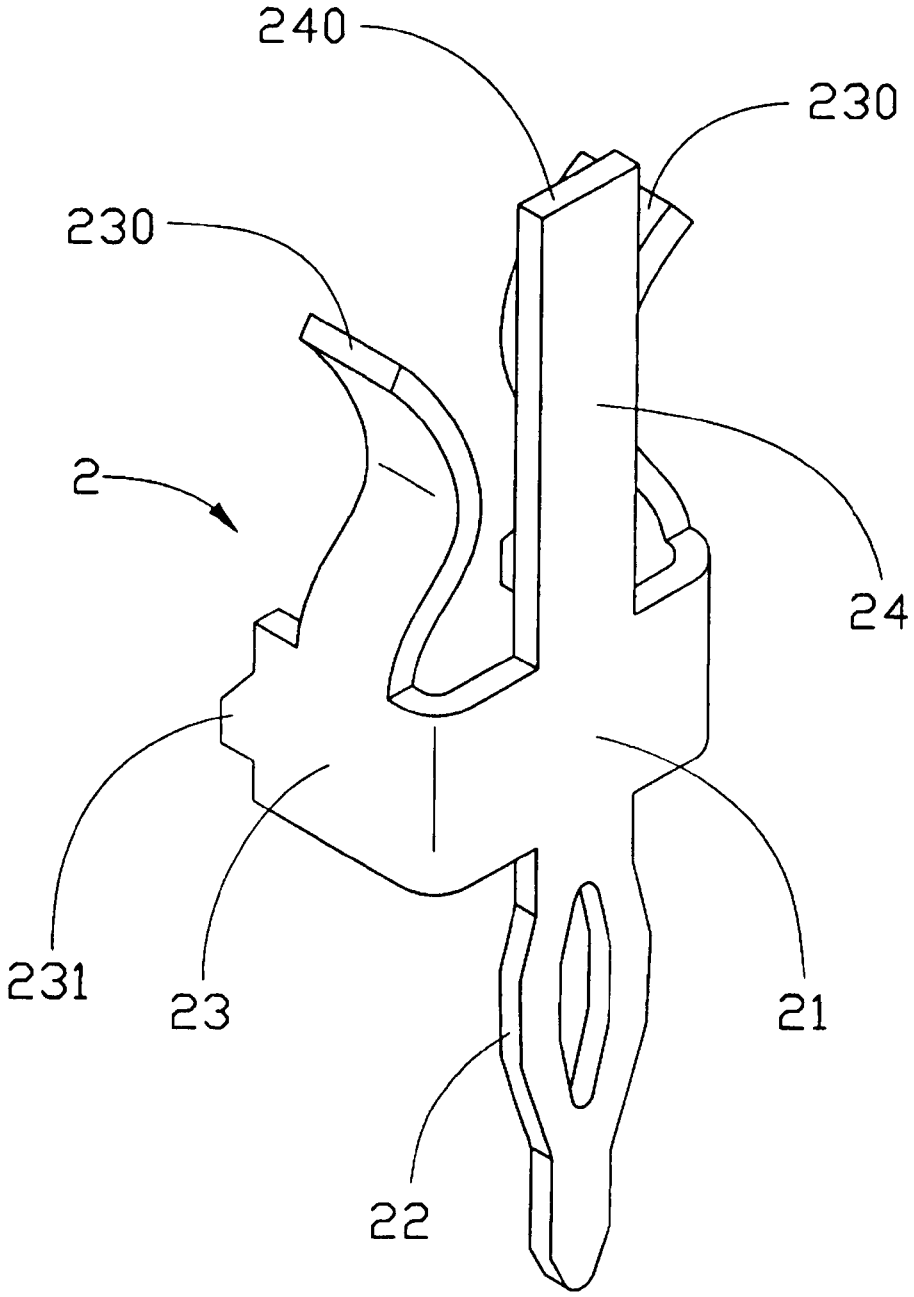
FIG. 4 is a perspective view of a contact of the electrical connector of FIG. 1.

As shown in FIG. 4, each contact 2, formed commonly by stamping operation, includes a base portion 21, a press-fit tail portion 22 extending downwardly from a lower edge of the base portion 21, a pair of arm portions 23 extending perpendicularly from opposite ends of the base portion 21, and a retaining portion 24 extending upwardly from an upper edge of the base portion 21. The pair of arm portions 23 each has a spring contacting portion 230 extending upwardly for engaging with a corresponding plug contact (not shown), and a barb portion 231 protruding from a free end thereof for securing into corresponding recess 133 of the housing 1. The barb portion 231 and the retaining portion 24 are located at opposite sides of the contacting portion 230.

Figure 5:
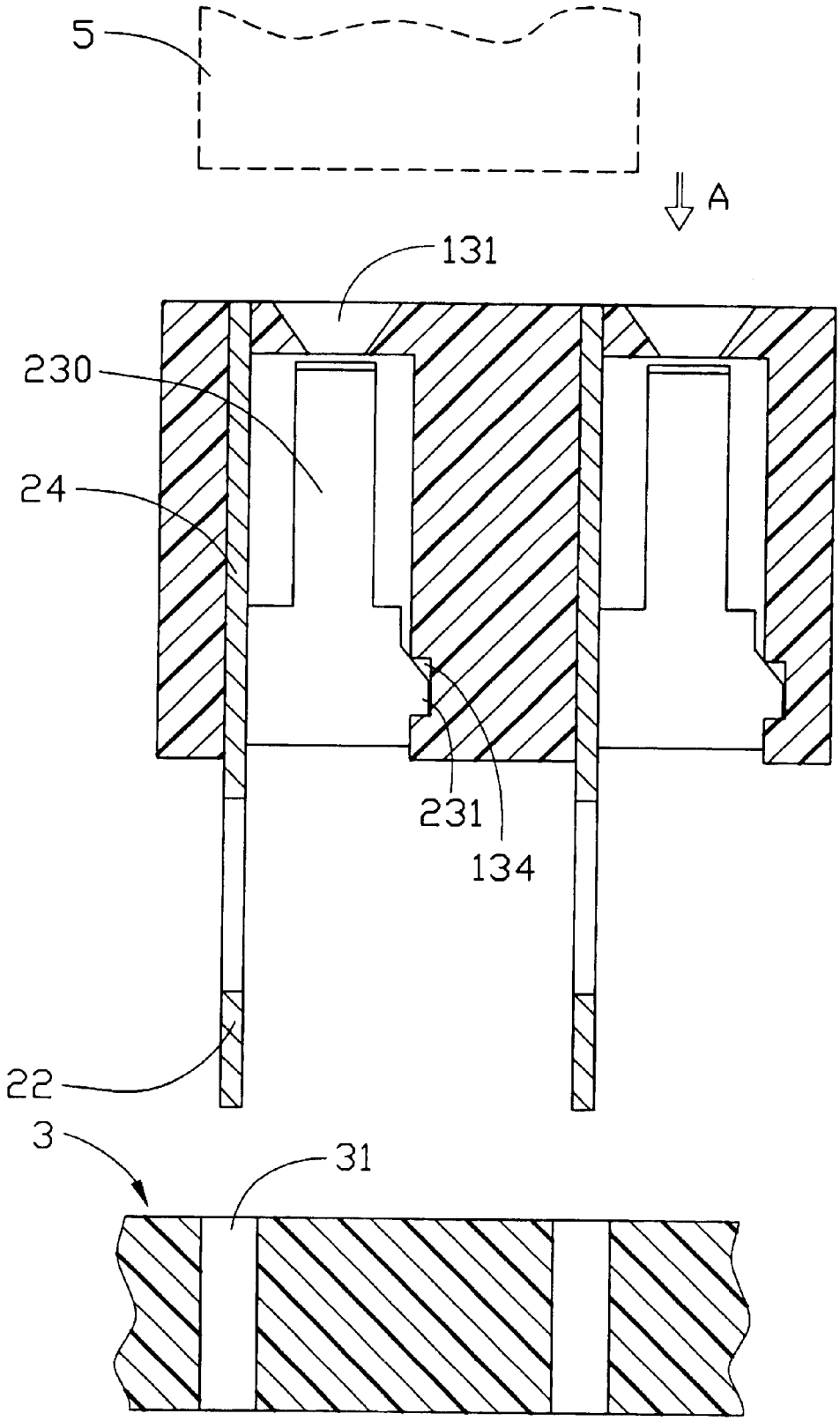
FIG. 5 is a cross-sectional view of the electrical connector, taken along line V—V of FIG. 1, and a tool for mounting the connector to the PCB.
Figure 6:
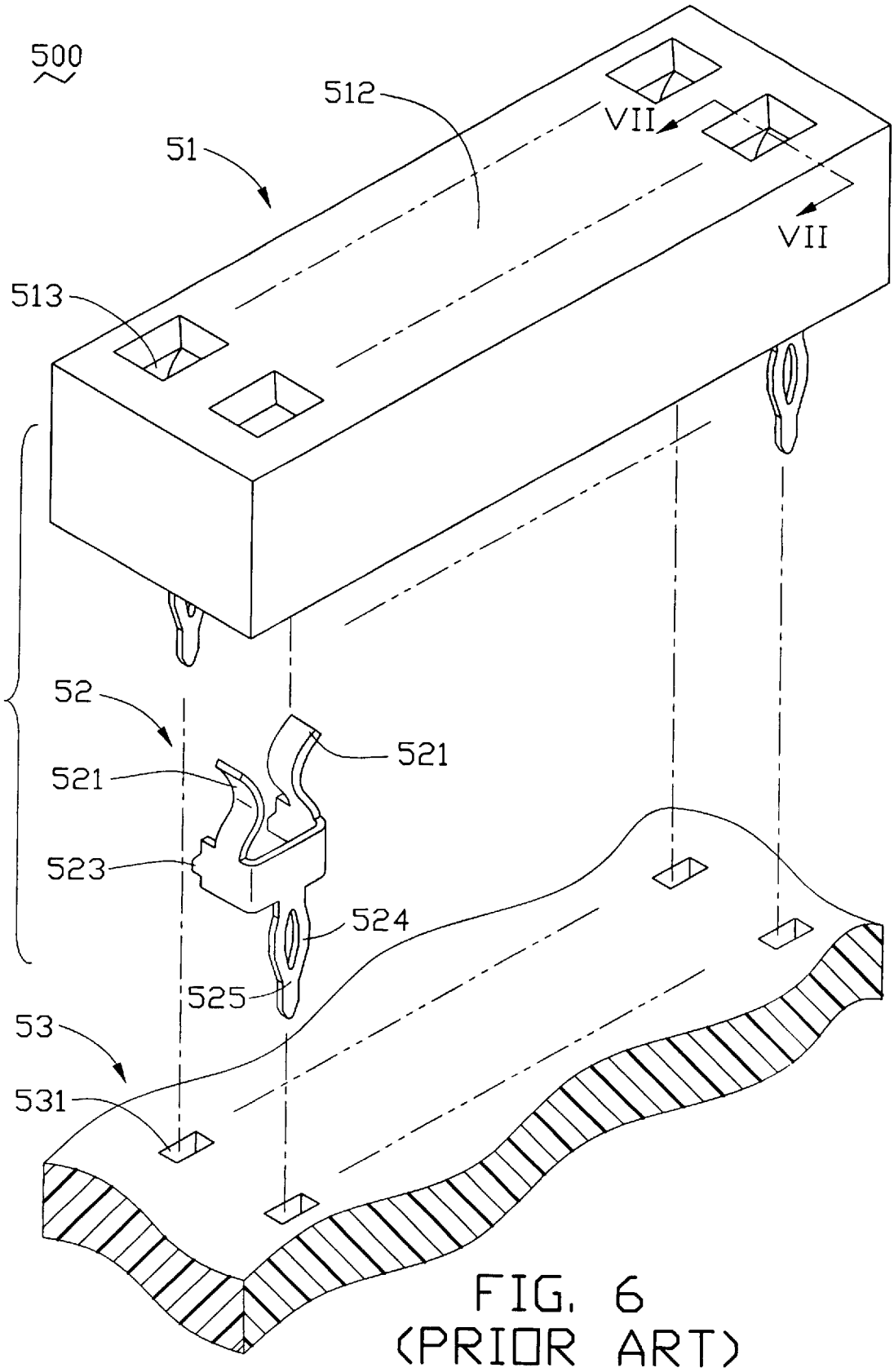
FIG. 6 (PRIOR ART)
FIG. 6 is an exploded view of a conventional electrical connector together with a PCB.
Figure 7:
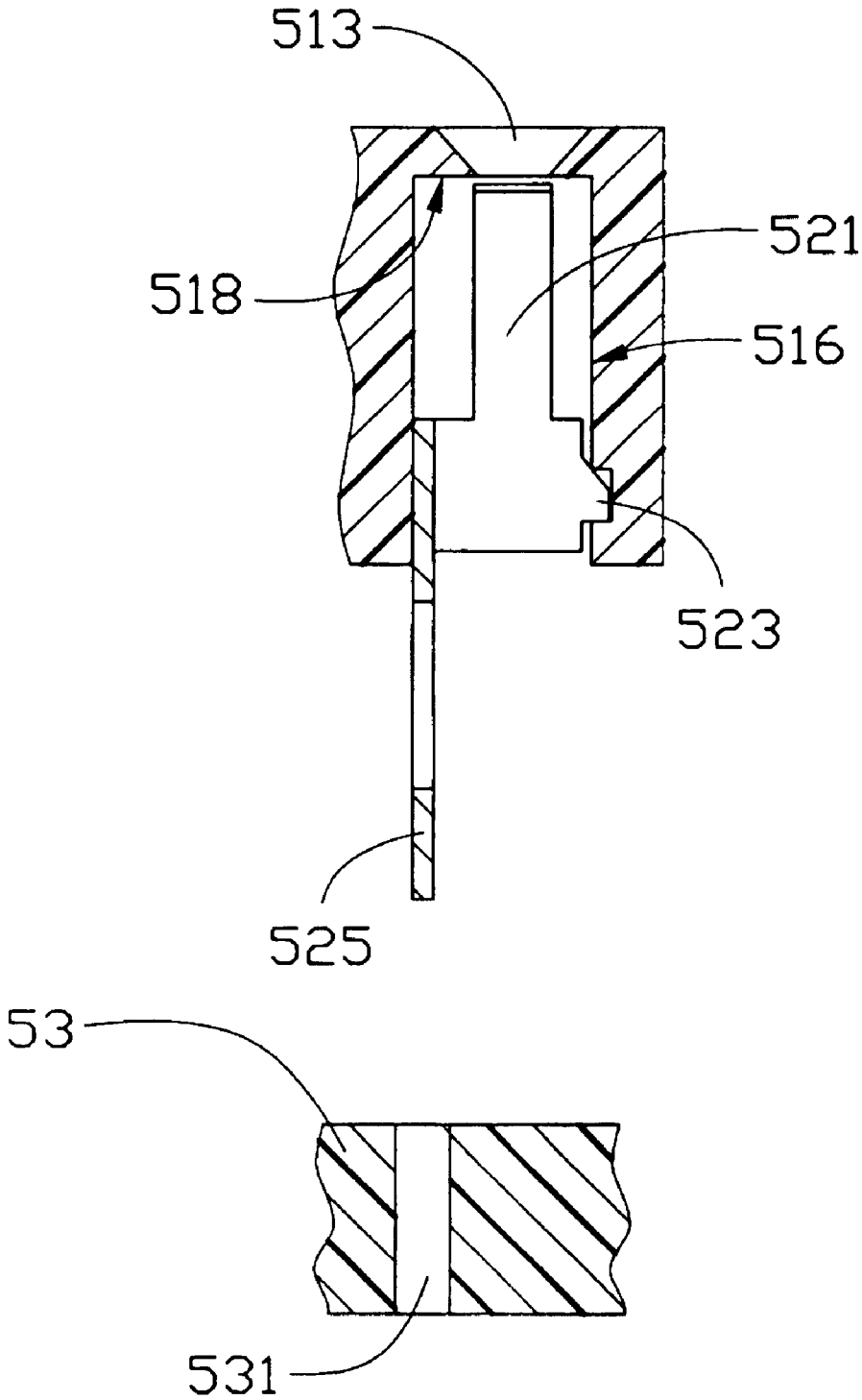
FIG. 7 (PRIOR ART)
FIG. 7 is a cross-sectional view of the connector and the PCB taken along line VII—VII of FIG. 6.

Referring to FIG. 5, the contacting portions 230 and the base portion 21 of the contact 2 are accommodated in the receiving room 132, the retaining portion 24 is received in the retaining slot 14, and the tail portion 22 extends out from the passageway 13. Top edge 240 of the retaining portion 24 is flush with the top surface 12 of the housing 1.

The connector 100 is mounted to the PCB 3 by a tool 5. As the tool 5 moves downwardly, the tail portions 22 of the contact 2 are inserted into the through holes 31 of the PCB and the top edges 240 of the retaining portion 24 abut upwardly against the tool 5. Since the through holes 31 are smaller than the tail portions 22, the contacts 2 suffer an upward force which forces the contacts 2 to slide upwardly. Nevertheless, the contacts 2 are retained in position in a way that the retaining portions 24 are stopped by the tool 5 and the barb portions 231 locked in the recess 133. Moreover, the tail portion 22 and the retention portion 24 are aligned in a substantially same plane along the insert direction such that the force is completely counteracted by the tool 5 so as to prevent the contacts 2 from rotation in the passageway 13.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing defining a mating top surface having retaining slots and diverged openings, and a plurality of passageways connecting with the diverged openings and extending therethrough along a vertical direction, each of said passageways surrounded by faces of the housing;

a plurality of contacts respectively received within the corresponding passageways, each of said contacts defining a base portion with at least one arm extending therefrom in a lateral direction perpendicular to said vertical direction, a contact portion extending upwardly from said arm along said vertical direction, a retaining portion upwardly extending from the base and abutting against one of said faces, a tail portion downwardly extending from the base in vertical alignment with the retaining portion; and a printed circuit board, on which the housing is seated, defining a plurality of through holes; wherein an upper tip of said retaining portion of each of said contacts is stopped to move upwardly relative to the housing when the housing with the associated contacts is mounted to the printed circuit board with the tail portions of the contacts being inserted into the corresponding through holes, respectively; wherein each of the retaining slots is formed separately with the corresponding diverged opening in the mating top surface and each of the retaining slots is in communication with each of said passageways, in which the retaining portion of the corresponding contact is received; wherein said retaining slot extends upward through a top face of the housing to be exposed to an exterior in said vertical direction; wherein the tip of the retaining portion of each contact is flush with the top face of the housing and visible from the exterior.

2. The assembly as claimed in claim 1, wherein a barb is formed on the arm and engaged with another one of said faces of said housing opposite to said one face.

* * * * *